US008181406B2

(12) United States Patent
Tan et al.

(10) Patent No.: US 8,181,406 B2
(45) Date of Patent: May 22, 2012

(54) ENVIRONMENTALLY-FRIENDLY AND SECURE OUTDOOR SHELTER FOR OPERATIONAL CELLULAR EQUIPMENT

(75) Inventors: Thomas Tan, San Jose, CA (US); Roger Y. Finley, Roswell, GA (US)

(73) Assignee: Verizon Patent and Licensing Inc., Basking Ridge, NJ (US)

( * ) Notice: Subject to any disclaimer, the term of this patent is extended or adjusted under 35 U.S.C. 154(b) by 104 days.

(21) Appl. No.: 12/492,303

(22) Filed: Jun. 26, 2009

(65) Prior Publication Data

US 2010/0325985 A1 Dec. 30, 2010

(51) Int. Cl.
*E04B 1/70* (2006.01)

(52) U.S. Cl. ..... 52/302.3; 52/220.8; 52/302.1

(58) Field of Classification Search ..... 52/63, 302.1, 52/220.1, 220.8, 282.2, 302.7, 79.1, 79.6, 52/79.7, 79.8, 261, 262, 264, 198, 302.3; 454/33–38, 48, 137

See application file for complete search history.

(56) References Cited

U.S. PATENT DOCUMENTS 498,508 A * 5/1893 Drummond ..... 52/79.6
1,080,417 A * 12/1913 Clark ..... 52/101
1,951,360 A * 3/1934 Holzwarth ..... 60/39.17
2,219,272 A * 10/1940 Peterson ..... 52/71
2,364,144 A * 12/1944 Hunsaker ..... 454/239
2,883,712 A * 4/1959 Shelamer, Sr. ..... 52/63
3,004,592 A * 10/1961 Norton ..... 160/114
3,195,190 A * 7/1965 Malo ..... 52/69
3,241,273 A * 3/1966 Struben ..... 52/63
3,303,771 A * 2/1967 Nesher et al. ..... 454/187
3,905,483 A * 9/1975 Patrick ..... 211/190
4,145,855 A * 3/1979 Sheldon ..... 52/232
4,628,692 A * 12/1986 Pierce ..... 60/641.8
4,995,377 A * 2/1991 Eiden ..... 126/605
5,002,502 A * 3/1991 Hill ..... 439/536
5,078,047 A * 1/1992 Wimberly ..... 454/368
5,131,888 A * 7/1992 Adkins, II ..... 454/343
5,452,710 A * 9/1995 Palmer ..... 126/572
5,664,995 A * 9/1997 O'Keefe ..... 454/58
5,986,203 A * 11/1999 Hanoka et al. ..... 136/251
6,112,483 A * 9/2000 Murray et al. ..... 52/220.6
6,128,193 A * 10/2000 Moss et al. ..... 361/729
6,349,510 B1 * 2/2002 Haas et al. ..... 52/79.5
6,552,257 B1 * 4/2003 Hart et al. ..... 136/246
6,559,552 B1 * 5/2003 Ha ..... 290/54
6,606,823 B1 * 8/2003 McDonough et al. ..... 47/65.9
2003/0009954 A1 * 1/2003 Bradley ..... 52/79.1
2003/0101668 A1 * 6/2003 Monden et al. ..... 52/220.8
2003/0105556 A1 * 6/2003 Enis et al. ..... 700/286
2003/0209206 A1 * 11/2003 Campbell ..... 119/513
2004/0139689 A1 * 7/2004 Sinha et al. ..... 52/745.15
2008/0163563 A1 * 7/2008 Sciglia ..... 52/63

* cited by examiner

*Primary Examiner* — Robert Canfield
*Assistant Examiner* — Babajide Demuren

(57) ABSTRACT

A temperature and humidity controlled building houses sensitive telecommunications equipment in operation. A secure outdoor shelter within a closed perimeter abutting the building utilizes the exterior of one wall of the building as a portion of its perimeter. The outdoor shelter contains outdoor-hardened telecommunications equipment, also in operation, which dissipates large quantities of heat to the atmosphere. There are coax cable and waveguide operative interconnections between the sensitive telecommunications equipment and the outdoor-hardened telecommunications equipment, the interconnection being made through the one wall without affecting control of the temperature and humidity in the building. There is a further coax cable and waveguide connection from the outdoor equipment to a cell tower where wireless transmission takes place. The outdoor shelter can be expanded modularly.

7 Claims, 4 Drawing Sheets

ENVIRONMENTALLY-FRIENDLY AND SECURE OUTDOOR SHELTER FOR OPERATIONAL CELLULAR EQUIPMENT

BACKGROUND INFORMATION

Cellular or wireless telecommunication systems typically use tall cell towers which are widely deployed. They can be easily seen, for example, as one drives along the U.S. Interstate highway system. Cellular-system equipment, such as amplifiers, filters, and/or power supplies, etc., used for generating the signals radiated from a tower's antennae may be positioned on top of that tower if that equipment is outdoors-hardened. Outdoors-hardened equipment can withstand wide temperature variations such as, e.g., from minus 20 to plus 55 degrees Centigrade, with high humidity. Alternatively, such equipment, with or without outdoor-hardening, may be located inside a building alongside other more sensitive operating cellular-system equipment that needs a temperature/humidity-controlled environment. Both of these locations are problematic for different reasons.

For equipment atop a tower that has malfunctioned, any servicing of that equipment must be handled by specially-trained, "certified riggers" who are capable of climbing tall towers and repairing that equipment under hazardous conditions. Not only must these people perform intricate repair and replacement tasks on top of these tall towers, but when severe weather conditions intervene, which may have contributed to the malfunction in the first place, this can make their tasks even more dangerous. When these repairs must be made on a priority or emergency basis, they cannot wait for better weather conditions. Therefore, these specialized personnel are paid very well for their services which are very costly for the telecommunications company needing them.

In the other case, for equipment that is outdoor-hardened but housed in an environmentally-controlled building, that equipment causes the telecommunications company to build a larger building than they would otherwise have to build. A larger building, based on local zoning or property-line setback requirements, may require a larger lot size, costing more, as compared with a lot for a smaller building. Of course, there are higher costs of construction for a bigger building. Further, because of the building's larger size and because of the heat-contribution from the unnecessarily housed equipment, there are much higher costs of installation and maintenance of the air conditioning and humidity control systems. There is a need, therefore, to locate outdoor-hardened operating equipment outdoors, in a safe and secure place which is easily accessed by cellular system technicians who are not certified riggers, and which does not require a larger than necessary, environmentally-controlled, building with its higher costs and inefficiency.

DETAILED DESCRIPTION OF PREFERRED EMBODIMENTS

Figure 1:
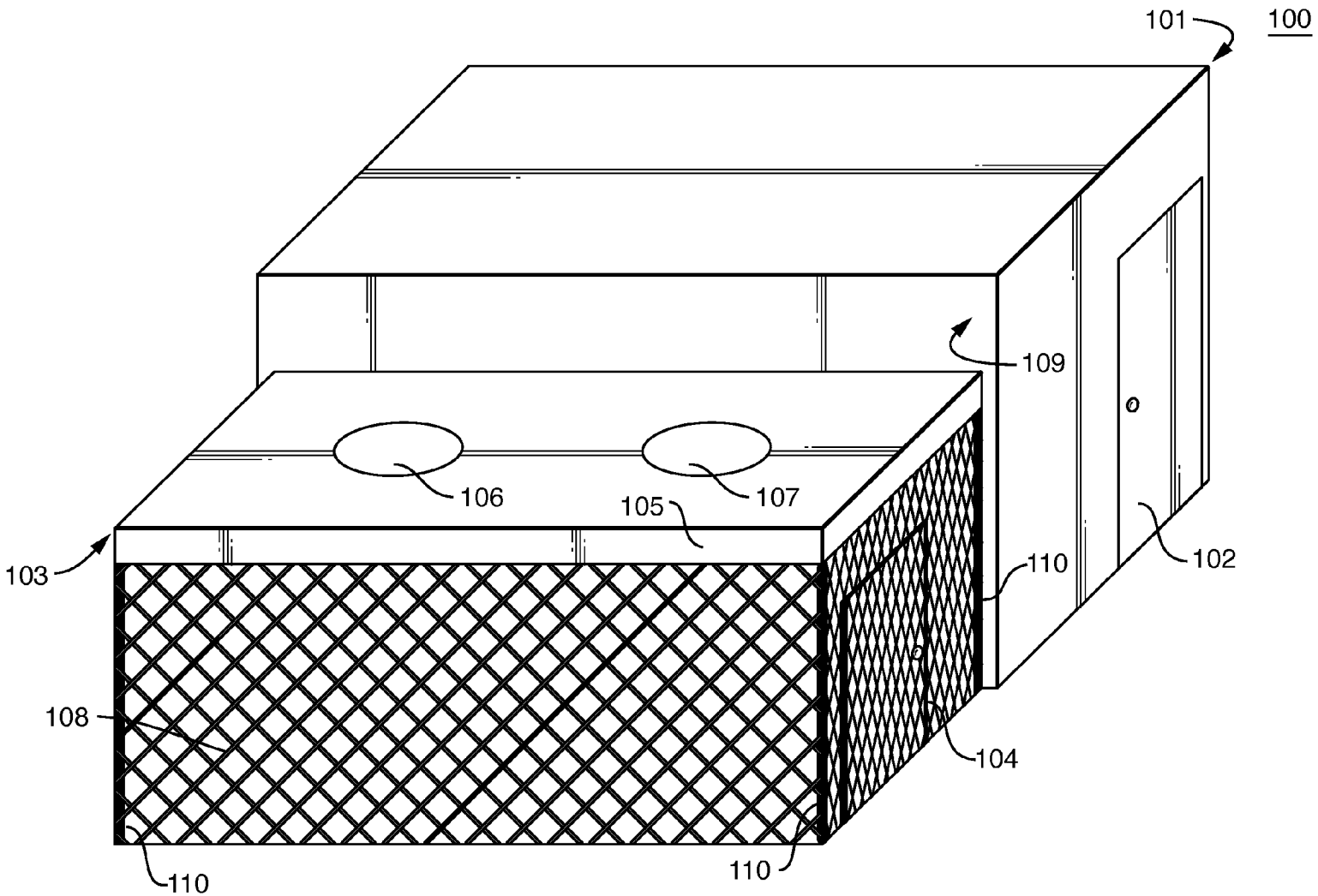
FIG. 1 is a perspective view of an exemplary embodiment.

In this description, the same reference numeral in different Figs. refers to the same entity. Otherwise, reference numerals of each Fig. start with the same number as the number of that Fig. For example, FIG. 3 has numerals in the "300" category and FIG. 4 has numerals in the "400" category, etc.

In overview, exemplary apparatus, methodology and system embodiments provide an outdoor shelter for Base Station Subsystem (BTS) or cellular equipment which is operating. The outdoor shelter is constructed adjacent to, and abutting, a pre-existing building, using the exterior of one of the building's walls as one of its walls. Equipment located and operating in the building is operatively coupled, using feed-throughs, through that one of the building's walls to equipment located and operating in the outdoor shelter.

In further detail, the outdoor shelter apparatus includes a foundation made, e.g., from concrete. Three walls are supported by the foundation, only one of the three walls connecting to the other two walls to partially define an operating-equipment space which can be viewed as a storage space, although powered equipment, in operation, is included therein. The three walls are constructed from material that is designed to facilitate air flow through them such as, e.g., a steel mesh fence. A dual layer roof is supported by the three walls or lally-columns or fence-posts associated with those walls/fence, and a solar-powered exhaust fan is installed within the roof to draw air from outside the three walls, through the storage space and out through the roof to cool the BTS and/or cellular equipment contained therein.

A fourth wall of the outdoor shelter, namely, the exterior of one of the building's walls noted above, is the exterior of one wall of a controlled-environment building. That building houses other more sensitive cellular equipment, in operation, which needs to operate only in a temperature and humidity controlled environment. The building's exterior wall is connected to the other two walls to completely define an outdoor storage space. The completely defined outdoor storage space is peripherally-bounded by that exterior wall and the three walls supported by the foundation, is upper-bounded by the roof and is lower-bounded by the foundation.

The outdoor shelter methodology includes the positioning of outdoors-hardened operational cellular telecommunications equipment outside, but inside a closed perimeter. The perimeter is defined by a fence, e.g., a steel mesh fence, and the exterior of one wall of a permanent building. The fence includes a lockable door and is supported by a foundation, e.g., made of concrete. The fence's fence-posts are also made of steel and can support a roof. The fence can extend from the foundation to the roof whereby the closed perimeter can be accessed only by someone who has a key to the door.

The methodology further includes installing an equipment rack which is boltable to the concrete foundation. The rack holds the outdoor-hardened equipment above the foundation by a predetermined distance or distances. The equipment can be positioned centrally within the perimeter by bolting the rack to the concrete foundation at that position. A manually operable visual-barrier can be installed inside the perimeter, surrounding the equipment to prevent a clear view of the equipment while not blocking air flow to and through the equipment. The visual barrier can be one of a variety of items such as, e.g., a set of outdoor-compatible vertical blinds positioned completely around the equipment and located inside the perimeter, or an equipment cabinet with air-holes formed therethrough that fits over the equipment rack and the equipment, etc.

The indoor/outdoor "green" shelter system includes the combination of a pre-existing, climate-controlled, building using the exterior of one of its walls as a fourth wall for an external equipment shelter constructed on a concrete slab and peripherally bounded by a steel-mesh cage extending from the concrete slab to a roof supported by the cage, solar powered exhaust fans being located in the roof. Cables connecting cellular equipment in operation inside the building pass through feedthroughs embedded within the one wall to cellular equipment in operation outside of the building and located in the external equipment shelter. Processed signals are forwarded on cables and waveguides from the outdoors cellular equipment to antennae on one or more towers for wireless transmission to intended receivers in accordance with standard wireless protocol.

FIG. 1 is a perspective view of an exemplary embodiment. Indoor/Outdoor telecommunications equipment shelter system 100 includes permanent building 101 abutting outdoor shelter 103. Building 101 is in operative communication with outdoor shelter 103 via cable and waveguide feedthroughs (not shown in this Fig.) inserted through wall 109 of building 101. Building 101 is accessed by lockable door 102 and attached outdoor shelter 103 is accessed by lockable door 104. Building 101 is temperature and humidity controlled to provide the proper operating environment for indoor telecommunications equipment, such as: cellular base station systems, telecommunication network devices, microwave radio systems, alarm systems and power supply and battery systems. In particular, standby DC batteries must be maintained inside building 101 in a controlled environment to achieve maximum battery life. Outdoor shelter 103 has a dual-surface roof 105 providing a sufficient thickness or space between surfaces to allow solar-powered exhaust fans 106 and 107 to be embedded therein. These fans, powered by sunlight, aid in cooling the area under the roof where heat-generating, outdoors-hardened operating telecommunications equipment, such as outdoor-hardened power supply systems and radio frequency (RF) components such as power amplifiers and low-noise amplifiers, etc., of base station systems and microwave radio systems can be sheltered, while operating, without requiring air-conditioning or humidity control, making this a "Green" shelter. The indoor equipment and outdoor equipment are operationally connected together via the feedthroughs, discussed below.

The walls 108 of outdoor shelter can be constructed of any strong material which serves to keep trespassers out of the shelter, which can withstand an outdoor environment and which allows air flow there-through. In a particular embodiment, walls 108 can be made from steel-mesh fencing attached to vertical steel fence posts or lally-columns 110 positioned at the two corners of the fence-walls and at the two ends of the steel mesh fencing where they abut wall 109 of building 101. The lally-columns or fence posts are supported by a foundation, such as a concrete slab foundation (not shown in this Fig.) which underlies the area of outdoor shelter 108 and abuts the foundation of building 101, and the steel-mesh fencing extends from foundation to roof to prevent unauthorized access. The outside of wall 109 of building 101 forms the fourth wall of outside shelter 103. Roof 105 can be pitched away from building 101 to facilitate drainage. Typical size of outdoor shelter 103 can be 12 ft. by 20 ft. floor area by 9 ft high, larger or smaller, and is not restricted to any particular size, and building 101 is at least as large as shelter 103.

Figure 2:
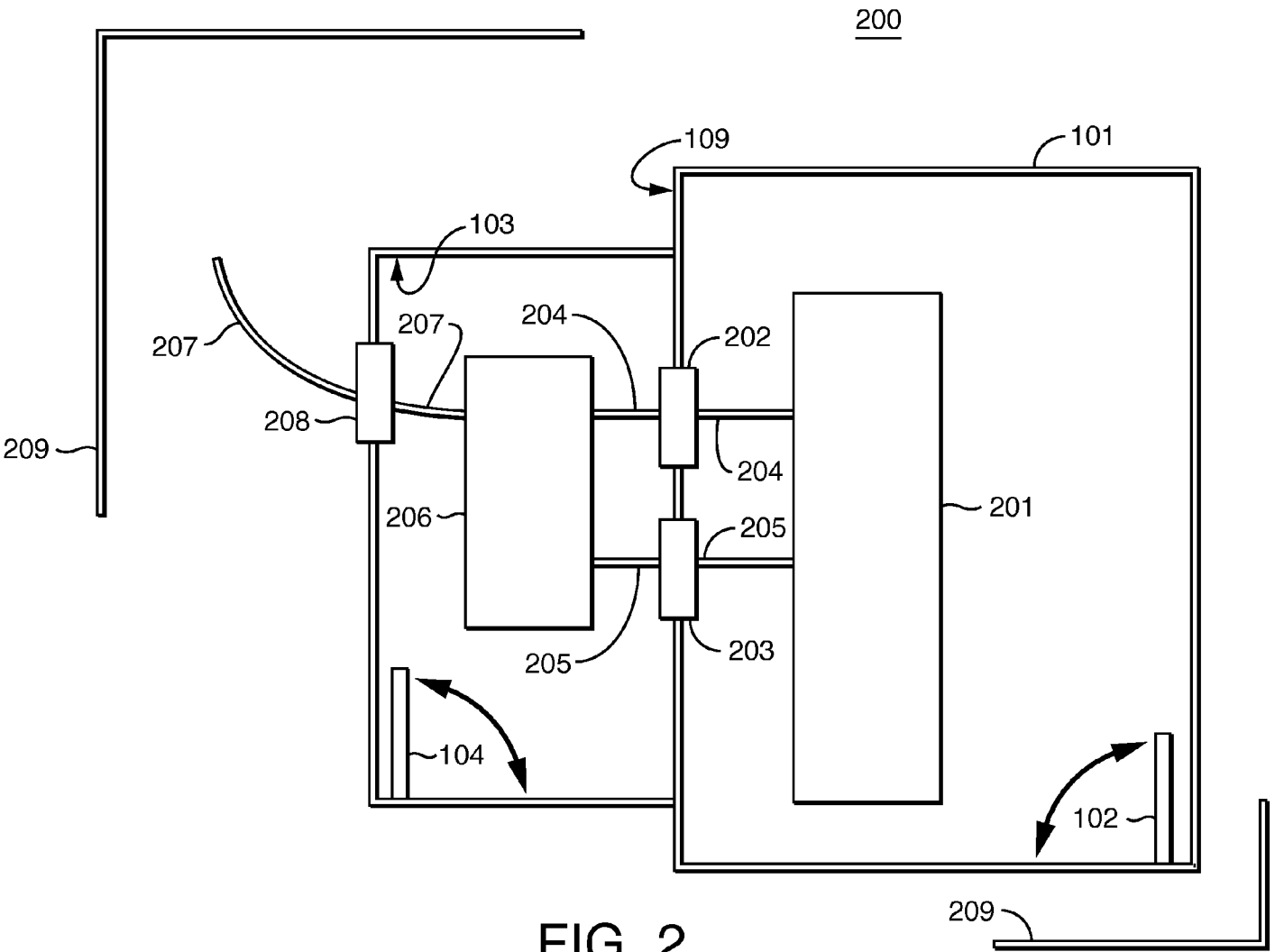
FIG. 2 is a top view, in schematic format, of the exemplary embodiment of FIG. 1.

FIG. 2 is a top view, in schematic format, of the exemplary embodiment of FIG. 1.

In this Fig. indoor equipment 201 is shown inside building 101 and outdoor equipment 206 is shown outside, in outdoor shelter 103. Feedthroughs 202 and 203 are weatherproofed rubber gaskets or the like, which are tightly-fitted into and through holes in wall 109, thereby connecting the inside of building 101 to the inside of shelter 103. Cables such as waveguide, coax and power cables can be tightly-fitted through those feedthroughs which allows indoor equipment 201 to be operatively connected to outdoor equipment 206, while maintaining the temperature/humidity integrity inside building 101. Cable 205 connects electrical power from indoor equipment 201 to outdoor equipment 206 through feedthrough 203. Cable(s) 204 connects information and/or data signals from indoor equipment 201 to outdoor equipment 206 through feedthrough 202.

Feedthrough 208 is affixed to outdoor shelter wall 208 or, alternatively, can be inserted through outdoor shelter roof 105. In either case, feedthrough 208 is used only to support cable 207 which conducts the information and/or data signals, after they have been processed (e.g., amplified, filtered, etc.) by equipment 206 and does not contribute to controlling ambient temperature and humidity as feedthroughs 202/203 do with respect to building 101. These processed signals are conducted to a cellular tower (not shown) where they are radiated, or wirelessly transmitted, in accordance with cellular transmission protocols. A perimeter fence 209 (a fragment being shown in FIG. 2) can enclose both the outdoor shelter 103 and the pre-existing building 101, and it can also be gated with a lockable door.

Figure 3:
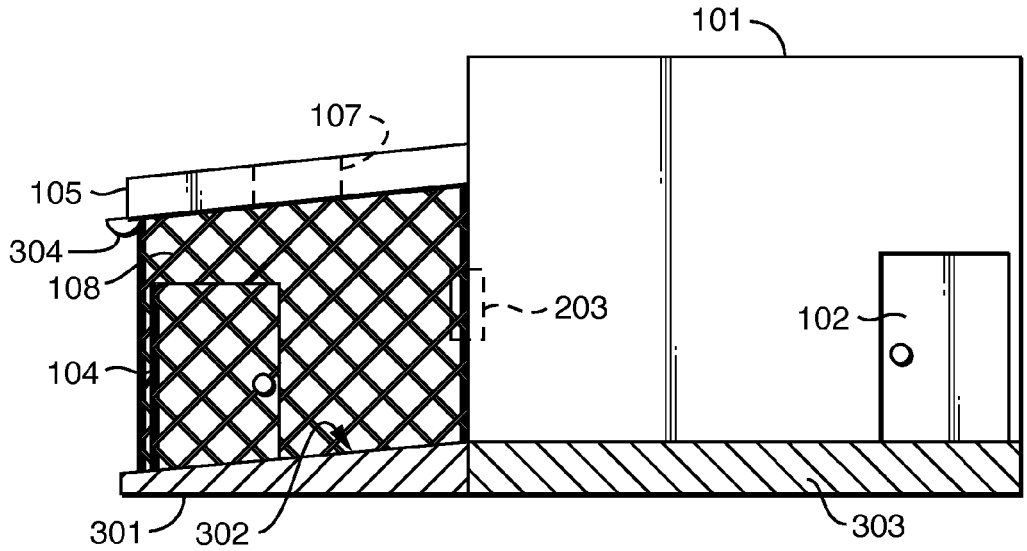
FIG. 3 is a side view, in schematic format, of the exemplary embodiment of FIG. 1.

FIG. 3 is a side view, in schematic format, of the exemplary embodiment of FIG. 1. In this view, foundation 301 is shown in cross-section. Typically it is a concrete slab, which has a sloped surface 302 to encourage drainage in a particular direction. In this embodiment, drainage is away from building 101; this is not a major problem because building 101 can also be constructed on a concrete slab, such as slab 303 and, without a basement, drainage is less of an issue than otherwise. Gutter 304 is provided to catch rainfall from roof 105. Fan 107 is shown embedded in the roof, as hidden lines.

Figure 4:
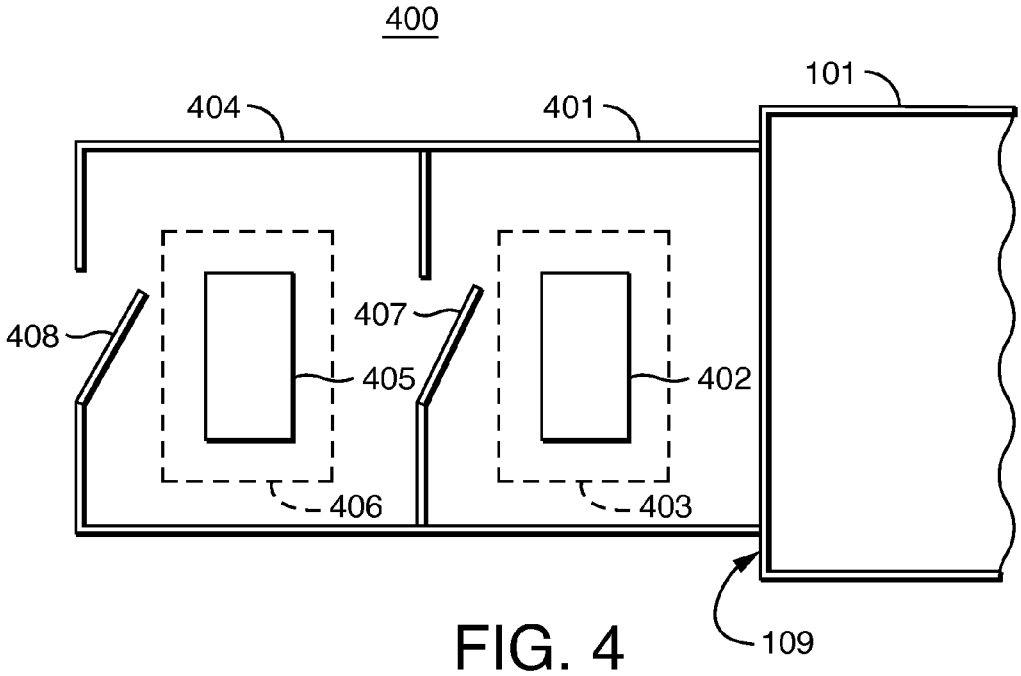
FIG. 4 is a top view, in schematic format, of an exemplary alternative embodiment, offering modularity.

FIG. 4 is a top view, in schematic format, of an alternative embodiment 400, offering modularity. Building 101 is shown at the right of the Fig. A first outdoor shelter space, or closed perimeter, 401 is shown affixed to the exterior of wall 109 of building 101 similarly to how shelter space 103 was affixed to the exterior of wall 109 of building 101 in FIGS. 1-3. However, in this alternative embodiment, door 407 is located in a different position from location of door 104 to facilitate modularization.

A second outdoor shelter space, or closed perimeter, 404 is shown abutting the first outdoor space, and this second outdoor space sits on its own foundation (not shown in this Fig.) This second outdoor space uses one wall, or one steel-meshed fencing section, of outdoor space 401 as its own fourth wall and has its own entry door 408. As can be seen, if one has a key to only entry door 408 to the second outdoor space he/she cannot open locked door 407 to the first outdoor space. But, if a technician has keys to both doors, both outdoor spaces are accessible to that technician.

This is a technique in modularization of outdoor shelter spaces. Each additional space can be tacked-on to the last most previous shelter space, in modular fashion, as additional shelter is needed for outdoors-hardened operational cellular telecommunications equipment. This modular expansion is limited only by the land size.

Inside first outdoor space 401, outdoors-hardened operational cellular telecommunications equipment 402 is shown centrally located inside first closed perimeter 401. A manually operable visual-barrier 403 is shown, schematically, inside of the first closed perimeter, surrounding equipment 402 and configured to prevent anyone standing outside perimeter 401 from clearly viewing equipment 402 while simultaneously not blocking air flow from reaching the equipment. Inside second outdoor space 404, outdoors-hardened operational cellular telecommunications equipment 405 is shown centrally located inside this second closed perimeter 404. A manually operable visual-barrier 406 is shown inside of the second closed perimeter, surrounding equipment 405 and configured to prevent anyone standing outside perimeter 404 from clearly viewing the equipment while simultaneously not blocking air flow from reaching the equipment. These visual barriers can be, e.g., sets of vertical blinds, controllable by a technician to be partially opened or completely open or closed.

Figure 5:
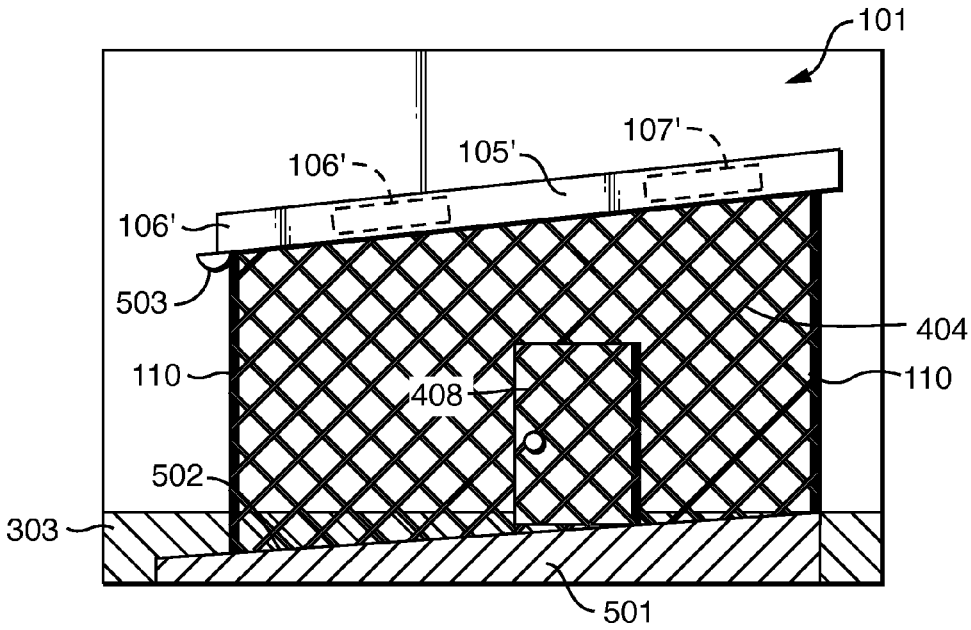
FIG. 5 is a rear view, in schematic format, of the exemplary alternative embodiment of FIG. 4.

FIG. 5 is a rear view, in schematic format, of the alternative embodiment of FIG. 4. In this view building 101 is shown located behind outdoor shelter spaces 401 and 404. This shows roof 105' sloping from right to left for purposes of facilitating modular construction, the roof containing embedded fans 106' and 107', rather than roof 105 sloping away from building 101 as shown in FIG. 3. Gutter 503 is positioned to catch rainfall runoff from the roof Foundation 501 has a sloped floor 502 sloping in the same direction as the slope of the roof. Foundation 303 of the building 101 is shown behind slab 501.

Using this alternate roof-slope and floor-slope configuration as modules are added, the roof can be maintained at this consistent elevation from the ground and the foundation can likewise be maintained at this consistent elevation upon, or in, the ground and modules can be extended to the limits of the land parcel. Otherwise, if using the direction of roof slope and direction of concrete floor slope of FIG. 3, as outdoor shelter spaces are modularly added, the decreasing height of the roof would be a limiting factor, as well as requiring more complex excavation for the concrete slab. In addition, this design permits drainage on the left side of the outdoor shelter, where gutter 503 would drain, and side drainage is out of the way of further modular expansion.

Figure 6:
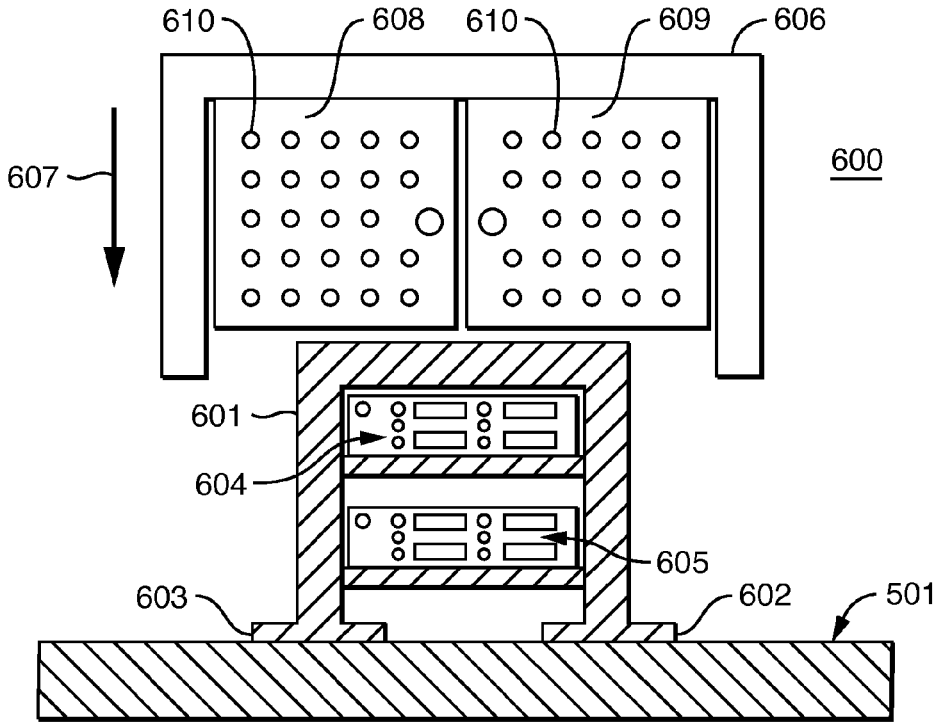
FIG. 6 is a schematic drawing of a visual barrier system, showing operational cellular-system equipment positioned in a floor-boltable equipment rack and configured to be enclosed by an enveloping equipment cabinet having openings to permit air circulation.

FIG. 6 is a schematic drawing of visual barrier system 600, showing operational cellular-system equipment positioned in a floor-boltable equipment rack and configured to be enclosed by an enveloping equipment cabinet having openings to permit air circulation. Concrete floor 501, depicted horizontal in this Fig. for clarity of illustration, is shown supporting equipment rack 601 which can be bolted to the floor by way of bolts penetrating the floor through flanges 602 and 603. Outdoor hardened operational telecommunication equipment 604 and 605 is shown supported in equipment rack 601 and located at pre-determined positions above the floor. Equipment cabinet 606, shown schematically above equipment rack 601, fits over equipment rack 601 and its included equipment 604 and 605 in a manner to completely hide the equipment from view. Cabinet 606 moves in downward direction 607 until it rests on the concrete floor and hides the equipment. There are doors 608 and 609 allowing easy access by service personnel to the equipment. There are holes 610 in doors 608 and 609 and throughout the cabinet to promote good heat transfer from the equipment into the environment under influence of the outside air circulated around the equipment by operation of the exhaust fans in the ceiling.

In the preceding specification, various preferred embodiments have been described with reference to the accompanying drawings. It will, however, be evident that various modifications and changes may be made thereto, and additional embodiments may be implemented, without departing from the broader scope of the invention as set forth in the claims that follow. For example the steel wire-mesh fencing or walls of the outdoor shelter spaces can be augmented on a seasonal basis with fiberglass, aluminum or steel barriers if the outdoor environment is too cold, as, for example, in Alaska during the winter months. For another example, if the heat is too extreme, additional solar-powered fans can be positioned inside the closed perimeter and pointed directly at the equipment as augmented cooling, in addition to the ceiling fans. The specification and drawings are accordingly to be regarded in an illustrative rather than restrictive sense.

What is claimed is:

1. An operating-equipment shelter, comprising:

a foundation;

three walls supported by said foundation and connected together and to said foundation such that only one of said three walls connects to the other two walls to partially define an operating-equipment space, said walls constructed from material designed to facilitate air flow through said walls;

a roof supported by said three walls, said roof forming a roof space between a top layer of said roof and a bottom layer of said roof;

solar-powered exhaust fans installed within said roof space and configured to draw air from outside said three walls through said operating-equipment space;

a fourth wall, not supported by said foundation and not constructed from said material, connected to both of said other two walls whereby said three walls and said fourth wall convert said partially-defined operating-equipment space to a completely-defined operating-equipment space under said roof and above said foundation.

2. The shelter of claim 1 wherein said three walls are of equal height.

3. The shelter of claim 1 wherein said material is strong fencing material and/or steel mesh.

4. The shelter of claim 3 wherein said walls can be augmented with fiberglass, aluminum or steel shutters or blinds, such augmentation still permitting said air flow if desired.

5. The shelter of claim 1 wherein said foundation is concrete and electronic equipment racks or cabinets are mounted by bolts to said concrete foundation.

6. The shelter of claim 5 further comprising:

a first cable feed-through formed through said fourth wall allowing cables to be fed from outside, to inside, of said completely-defined operating-equipment space and to make operative connection to electronic equipment mounted in said racks or cabinets; and a second cable feed-through formed through one of said three walls allowing other cables to be fed from inside, to outside, of said completely-defined operating-equipment space and to make operative connection from said electronic equipment to communication equipment at locations remote to said completely-defined operating-equipment space.

7. The shelter of claim 1 including at least one lockable door located in at least one of said three walls, said door also constructed from said material.

* * * * *